US011024143B2

(12) United States Patent
Fong et al.

(10) Patent No.: US 11,024,143 B2
(45) Date of Patent: Jun. 1, 2021

(54) AUDIO EVENTS TRACKING SYSTEMS AND METHODS

(71) Applicant: PPIP LLC, Tempe, AZ (US)

(72) Inventors: Michael Fong, Chandler, AZ (US); Neric Hsin-Wu Fong, Tempe, AZ (US); Teddy David Thomas, Bedford, NH (US)

(73) Assignee: PPIP, LLC, Chandler, AZ (US)

( * ) Notice: Subject to any disclaimer, the term of this patent is extended or adjusted under 35 U.S.C. 154(b) by 0 days.

(21) Appl. No.: 16/526,435

(22) Filed: Jul. 30, 2019

(65) Prior Publication Data

US 2021/0035430 A1 Feb. 4, 2021

(51) Int. Cl.

| | |
|---|---|
| ***G08B 21/04*** | (2006.01) |
| ***H04R 5/04*** | (2006.01) |
| ***G08B 25/10*** | (2006.01) |
| ***G08B 5/38*** | (2006.01) |
| ***G08B 25/01*** | (2006.01) |
| ***H04R 3/00*** | (2006.01) |

(52) U.S. Cl.

CPC ..... *G08B 21/043* (2013.01); *G08B 5/38* (2013.01); *G08B 25/016* (2013.01); *G08B 25/10* (2013.01); *H04R 3/005* (2013.01); *H04R 5/04* (2013.01)

(58) Field of Classification Search

None

See application file for complete search history.

(56) References Cited

U.S. PATENT DOCUMENTS

| | | | | |
|---|---|---|---|---|
| 4,060,803 | A * | 11/1977 | Ashworth, Jr. .... | G08B 13/1672 340/506 |
| 5,651,070 | A * | 7/1997 | Blunt ..... | G08B 1/08 340/407.1 |
| 6,535,131 | B1 * | 3/2003 | Bar-Shalom ..... | A01K 11/008 340/573.1 |
| 7,957,225 | B2 * | 6/2011 | Steadman ..... | G08B 13/2491 367/124 |
| 10,482,901 | B1 * | 11/2019 | Maurer ..... | G06N 3/0454 |
| 2003/0016128 | A1 * | 1/2003 | Lutz ..... | G08C 19/00 340/517 |
| 2005/0280547 | A1 * | 12/2005 | Ropke ..... | H01Q 1/22 340/628 |
| 2006/0164234 | A1 * | 7/2006 | Acar ..... | G08B 25/009 340/539.1 |
| 2007/0237358 | A1 * | 10/2007 | Tseng ..... | G08B 13/19608 382/103 |

(Continued)

*Primary Examiner* — Curtis J King

(74) *Attorney, Agent, or Firm* — Fernando & Partners, LLP

(57) ABSTRACT

Disclosed is a method including, receiving, from one or more of a plurality of devices, one or more notifications indicating that one or more audio sound patterns have been detected. The method includes determining whether a same audio sound pattern is detected by two or more of the devices. The method further includes transmitting a notification to each device associated with the same audio sound pattern. The method further includes determining a location of the same audio sound pattern based on one or more criteria and transmitting a notification to each device associated with each of the same audio sound patterns. In some embodiments, the one or more criteria is a time, a duration, a frequency, an amplitude, a speed, or a direction of the audio sound pattern, and an aggregation of information from two or more of the devices.

20 Claims, 7 Drawing Sheets

(56) References Cited

U.S. PATENT DOCUMENTS

| | | | | |
|---|---|---|---|---|
| 2008/0169929 | A1* | 7/2008 | Albertson | G08B 13/19613 340/573.1 |
| 2009/0002494 | A1* | 1/2009 | Calhoun | G01S 7/003 348/159 |
| 2009/0051508 | A1* | 2/2009 | Yamano | G08B 17/00 340/384.1 |
| 2009/0085727 | A1* | 4/2009 | Yamano | G08B 17/00 340/384.4 |
| 2009/0096620 | A1* | 4/2009 | Kuo | G08B 17/10 340/628 |
| 2010/0128123 | A1* | 5/2010 | DiPoala | G08B 15/02 348/143 |
| 2011/0215946 | A1* | 9/2011 | Aguren | G08C 19/00 340/870.3 |
| 2013/0329863 | A1* | 12/2013 | Bentley | G08B 23/00 379/32.01 |
| 2014/0307096 | A1* | 10/2014 | Park | G01S 15/02 348/152 |
| 2015/0077567 | A1* | 3/2015 | Scalisi | H04N 7/183 348/152 |
| 2015/0145684 | A1* | 5/2015 | Schmid | G08B 17/10 340/628 |
| 2015/0310732 | A1* | 10/2015 | Piccolo, III | G08B 29/145 340/515 |
| 2015/0379836 | A1* | 12/2015 | Nye | G08B 29/188 340/565 |
| 2016/0163168 | A1* | 6/2016 | Brav | G08B 21/043 381/56 |
| 2017/0052539 | A1* | 2/2017 | Kerzner | G08B 13/19697 |
| 2019/0180735 | A1* | 6/2019 | Mcelhaney | G10L 15/02 |
| 2019/0295207 | A1* | 9/2019 | Day | G06Q 90/205 |
| 2020/0066120 | A1* | 2/2020 | Kaoh | G10L 15/22 |

* cited by examiner

AUDIO EVENTS TRACKING SYSTEMS AND METHODS

TECHNICAL FIELD

This relates generally to the field of sensing and detecting, and more specifically to an apparatus for detecting audio sound patterns.

BACKGROUND

Users in hostile sound environments, e.g., concerts, large gatherings, festivals, are only able to hear some of the louder audio sounds, e.g., higher amplitude sound signals. Amongst missed audio sounds, are the emergency audio sounds such as requests for help, gunshots, or sudden impact noises due to car accidents. In such instances, a system is required to detect emergency sound patterns, e.g., ad hoc sounds, and notify the users and/or emergency centers, e.g., police stations, 911, for help. The system further needs to determine a location where the emergency takes place.

BRIEF DESCRIPTION OF THE DRAWINGS

So that the present disclosure can be understood by those of ordinary skill in the art, a more detailed description can be had by reference to aspects of some illustrative embodiments, some of which are shown in the accompanying drawings.

Figure 1:
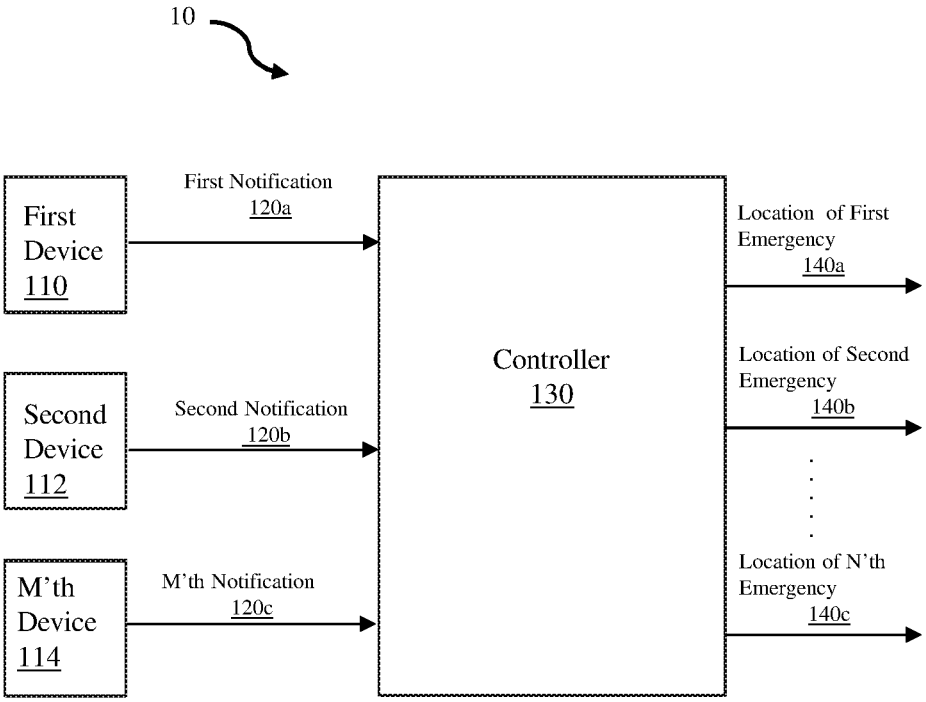
FIG. 1 is a block diagram of an audio events tracking system in accordance with some embodiments.

In accordance with common practice some features illustrated in the drawings cannot be drawn to scale. Accordingly, the dimensions of some features can be arbitrarily expanded or reduced for clarity. In addition, some of the drawings cannot depict all of the components of a given system, method or device. Finally, like reference numerals can be used to denote like features throughout the specification and figures.

DETAILED DESCRIPTION

Described herein are an apparatus and methods thereof for audio events tracking. According to some embodiments, the audio events tracking system includes a plurality of devices which is in communication with a controller through a network. The apparatus is configured to receive, from one or more of the plurality of devices, one or more notifications indicating that one or more audio sound patterns have been detected. In some embodiments, the plurality of devices is in communication with a controller through a network. The plurality of devices and the controller can communicate through a wireless network, e.g., a Wi-Fi network, an LTE network, etc. In some embodiments, at least one of the plurality of devices is a smartphone. In some embodiments, at least one of the plurality of devices includes a microphone to detect the audio signals. In some embodiments, at least one of the plurality of devices uses any suitable method to detect vibrations caused by the audio signals.

In some embodiments, at least one of the plurality of devices includes a receiver, a memory and one or more processors. In some embodiments, the receiver is configured to receive audio signals from the surrounding. The one or more processors are in communication with the memory and the receiver. The receiver can include a microphone or any suitable device to detect audio signals. In some embodiments, the receiver receives one or more audio signals. In some embodiments, the one or more audio signals are received from one or more sources. In some embodiments, the memory is configured to store one or more criteria to detect certain types of audio signals from the one or more audio signals received by the receiver. In some embodiments, the memory stores instructions on how to use the one or more criteria. In some embodiments, the memory is configured to store further instructions to respond to detecting certain types of audio signals received from the surrounding. In some embodiments, the one or more processors are configured to process the received audio signals based on the stored criteria in the memory.

In some embodiments, the apparatus determines whether a same audio sound pattern is detected by two or more of the devices. In some embodiments, once the one or more processors associated with a device of the plurality of devices determine that one or more received audio signals include at least one audio sound pattern that satisfies the one or more criteria stored in the memory, the device notifies the controller. According to some embodiments, the one or more criteria include at least one of a frequency of the audio signals, an amplitude of the audio signals, a speed of sound of the audio signals, and a sound pattern of the audio signals, a direction of the audio signals. In some embodiments, one or more audio sound patterns are stored in the memory associated with each of the plurality of devices.

In some embodiments, the audio sound pattern is a sound pattern indicative of an emergency event, e.g., a security alarm, a car alarm, a gunshot, etc. For example, the controller determines that more than one device has detected an alarm. In some embodiments, the apparatus is configured to transmit a notification to each device associated with the same audio sound pattern. In some embodiments, in association with transmitting the notification, an application is launched on each device. In some embodiments and, the application produces at least one of a sound, a vibration, and a flashing light. In some embodiments, the controller sends notification only to authorized devices. In some embodiments, the device is at least one of a smart phone, a smart watch, a laptop, a pager, and a tablets.

In accordance with some embodiments, a device includes one or more processors, non-transitory memory, and one or more programs; the one or more programs are stored in the non-transitory memory and configured to be executed by the one or more processors and the one or more programs include instructions for performing or causing performance of the operations of any of the methods described herein. In accordance with some embodiments, a non-transitory computer readable storage medium has stored therein instructions which when executed by one or more processors of a device, cause the device to perform or cause performance of the operations of any of the methods described herein. In accordance with some implementations, a device includes means for performing or causing performance of the operations of any of the methods described herein.

Reference will now be made in detail to embodiments, examples of which are illustrated in the accompanying drawings. In the following detailed description, numerous specific details are set forth in order to provide a thorough understanding of the various described embodiments. However, it will be apparent to one of ordinary skill in the art that the various described embodiments may be practiced without these specific details. In other instances, well-known methods, procedures, components, circuits, and networks have not been described in detail so as not to unnecessarily obscure aspects of the embodiments.

It will also be understood that, although the terms first, second, etc. are, in some instances, used herein to describe various elements, these elements should not be limited by these terms. These terms are only used to distinguish one element from another. For example, a first contact could be termed a second contact, and, similarly, a second contact could be termed a first contact, without departing from the scope of the various described embodiments. The first contact and the second contact are both contacts, but they are not the same contact, unless the context clearly indicates otherwise.

The terminology used in the description of the various described embodiments herein is for the purpose of describing particular embodiments only and is not intended to be limiting. As used in the description of the various described embodiments and the appended claims, the singular forms "a", "an", and "the" are intended to include the plural forms as well, unless the context clearly indicates otherwise. It will also be understood that the term "and/or" as used herein refers to and encompasses any and all possible combinations of one or more of the associated listed items. It will be further understood that the terms "includes," "including", "comprises", and/or "comprising", when used in this specification, specify the presence of stated features, integers, steps, operations, elements, and/or components, but do not preclude the presence or addition of one or more other features, integers, steps, operations, elements, components, and/or groups thereof.

As used herein, the term "if" is, optionally, construed to mean "when" or "upon" or "in response to determining" or "in response to detecting," depending on the context. Similarly, the phrase "if it is determined" or "if [a stated condition or event] is detected" is, optionally, construed to mean "upon determining" or "in response to determining" or "upon detecting [the stated condition or event]" or "in response to detecting [the stated condition or event]," depending on the context.

It should be appreciated that in the development of any actual implementation (as in any development project), numerous decisions must be made to achieve the developers' specific goals (e.g., compliance with system and business-related constraints), and that these goals will vary from one implementation to another. It will also be appreciated that such development efforts might be complex and time consuming but would nevertheless be a routine undertaking for those of ordinary skill in the art of image capture having the benefit of this disclosure.

Referring to FIG. 1, a simplified block diagram of an audio events tracking system 10 is depicted, in accordance with some embodiments. In some embodiments, the audio events tracking system 10 includes a plurality of devices, e.g., a first device 110, a second device 112, . . . , and an m'th device 114. The plurality of devices is in communication with a controller 130 through a network (not shown). The plurality of devices, e.g., the first device 110, the second device 112, and the m'th device 114, and the controller 130 can communicate through a wireless network, e.g., a Wi-Fi network, an LTE network, etc. In some embodiments, at least one of the plurality of devices, e.g., the first device 110, the second device 112, and the m'th device 114, is a smartphone. In some embodiments, at least one of the plurality of devices, e.g., the first device 110, the second device 112, and the m'th device 114, is a smart watch. In some embodiments, at least one of the plurality of devices, e.g., the first device 110, the second device 112, and the m'th device 114, is a pager. In some embodiments, at least one of the plurality of devices, e.g., the first device 110, the second device 112, and the m'th device 114, is a Personal Digital Assistance (PDA). In some embodiments, at least one of the plurality of devices, e.g., the first device 110, the second device 112, and the m'th device 114, includes a microphone to detect the audio signals. In some embodiments, at least one of the plurality of devices, e.g., the first device 110, the second device 112, and the m'th device 114, uses any suitable method to detect vibrations caused by the audio signals.

In some embodiments, at least one of the plurality of devices, e.g., the first device 110, the second device 112, and the m'th device 114, detects audio signals from the surrounding environment. The audio signals, e.g., acoustic waves, are longitudinal waves that propagate by means of adiabatic compression and decompression. The longitudinal waves are waves that have the same direction of vibration as their direction of travel. In some embodiments, an acoustic wave is a mechanical wave in which pressure variation propagates through a material. In some embodiments, audio signals. e.g., acoustic waves, transfer sound energy from one point to another without any net movement of the air particles or other media they pass through. In some embodiments, at least one of the plurality of devices, e.g., the first device 110, the second device 112, and the m'th device 114, includes a receiver, a memory and one or more processors. In some embodiments, the receiver is configured to receive audio signals from the surrounding. The one or more processors are in communication with the memory and the receiver. The receiver can include a microphone or any suitable device to detect audio signals. In some embodiments, the receiver receives one or more audio signals. In some embodiments, the one or more audio signals are received from one or more sources.

In some embodiments, at least one of the plurality of devices, e.g., the first device 110, the second device 112, and the m'th device 114, includes the memory which is configured to store one or more criteria to detect certain types of audio signals from the one or more audio signals received by the receiver. In some embodiments, the memory stores instructions on how to use the one or more criteria. In some embodiments, the memory is configured to store further instructions to respond to detecting certain types of audio signals received from the surrounding. In some embodiments, the at least one of the plurality of devices, e.g., the first device 110, the second device 112, and the m'th device 114, includes the one or more processors which are configured to process the received audio signals based on the stored criteria in the memory.

According to some embodiments, the one or more criteria include a frequency of the audio signals. In some embodiments, the one or more criteria include an amplitude of the audio signals. In some embodiments, the one or more criteria include a speed of sound of the audio signals. In some embodiments, the one or more criteria include a sound pattern of the audio signals. In some embodiments, the one or more criteria include a direction of the audio signals. In some embodiments, one or more audio sound patterns are stored in the memory associated with each of the plurality of devices. In some embodiments, the one or more processors determine whether each of the one or more audio signals includes an audio sound pattern that satisfies the one or more criteria stored in the memory.

In some embodiments, once the one or more processors associated with a device of the plurality of devices determine that one or more received audio signals include at least one audio sound pattern that satisfies the one or more criteria stored in the memory, the device notifies the controller 130. In some embodiments, each of the plurality of devices, e.g., the first device 110, the second device 112, and the m'th device 114, sends a notification, e.g., a first notification 120*a*, a second notification 120*b*, . . . , an m'th notification 120*c*, to the controller 130. In some embodiments, each of the plurality of devices sends one notification for each detected audio sound pattern detected by the device. Therefore, in some embodiments, any of the plurality of devices sends any number of notifications to the controller 130. In some embodiments, the audio sound pattern is a sound pattern indicative of an emergency event.

In some embodiments, the controller 130 determines whether a same audio sound pattern is detected by two or more of the devices. For example, the controller 130 determines that more than one device has detected an alarm. In some embodiments, the controller 130 transmits a notification to each device associated with the same audio sound pattern. In some embodiments, for each of the same sound patterns detected by two or more of the devices, the controller 130 determines a location of the same audio sound pattern based on one or more criteria. In some embodiments, the controller 130 transmits a notification to each device associated with each of the same audio sound patterns. In some embodiments, the notification includes a location of the same audio sound pattern, e.g., a location of first emergency 140*a*, a location of second emergency 140*b*, . . . , a location of n'th emergency 140*c*.

In some embodiments, the one or more criteria used by the controller 130 is a time the audio sound pattern is detected. In some embodiments, the one or more criteria used by the controller 130 is a duration of the audio sound pattern. In some embodiments, the one or more criteria used by the controller 130 is a frequency of the audio sound pattern. In some embodiments, the one or more criteria used by the controller 130 is an amplitude of the audio sound pattern. In some embodiments, the one or more criteria used by the controller 130 is a speed of the audio sound pattern. In some embodiments, the one or more criteria used by the controller 130 is a direction of the audio sound pattern. In some embodiments, the one or more criteria used by the controller 130 is and an aggregation of information from two or more of the devices.

In some embodiments, upon determining the location of the audio sound pattern, the controller 130 transmits a notification to at least one of a police station near the location of the audio sound pattern, a fire department near the location of the audio sound pattern, and an emergency center near the location of the audio sound pattern.

In some embodiments, in association with transmitting the notification, an application is launched on each device. In some embodiments, the application produces at least one of a sound, a vibration, and a flashing light.

Figure 2:
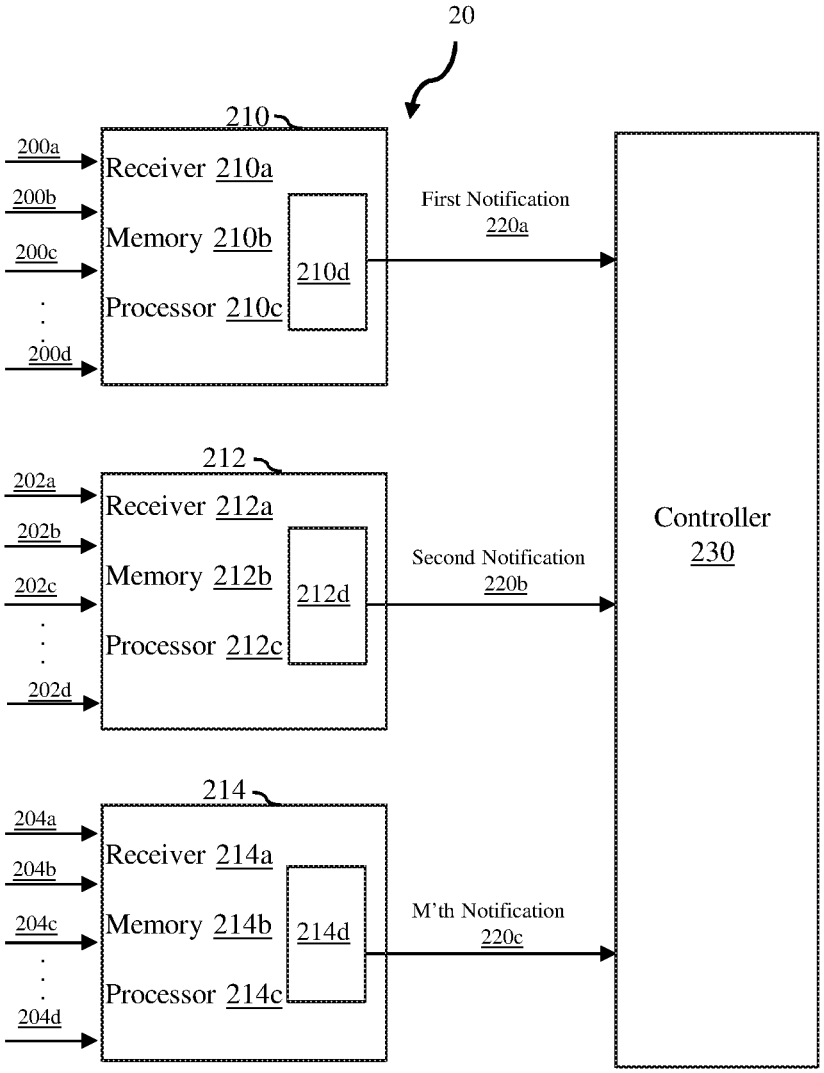
FIG. 2 is a block diagram of an audio events tracking system in accordance with some embodiments.

FIG. 2 illustrates a simplified block diagram of an audio events tracking system 20, in accordance with some embodiments. In some embodiments, a plurality of devices, e.g., a device 210, a device 212, a device 214, are in communication with a controller 230. In some embodiments, the plurality of devices is in communication with a controller 230 through a network (not shown). The plurality of devices, e.g., the device 210, the device 212, and the device 214, and the controller 230 can communicate through a wireless network, e.g., a Wi-Fi network, an LTE network, etc. In some embodiments, at least one of the plurality of devices, e.g., the device 210, the device 212, and the device 214, is a pager. In some embodiments, at least one of the plurality of devices is a PDA. In some embodiments, at least one of the plurality of devices includes a microphone to detect the audio signals. In some embodiments, at least one of the plurality of devices uses any suitable method to detect vibrations caused by the audio signals.

In some embodiments, at least one of the plurality of devices detects audio signals from the surrounding environment. In some embodiments, each of the plurality of devices includes a receiver, e.g., a receiver 210*a*, a receiver 212*a*, a receiver 214*a*, a memory, e.g., a memory 210*b*, a memory 212*b*, a memory 214*b*, and one or more processors, e.g., one or more processors 210*c*, one or more processors 212*c*, more or more processors 214*c*. In some embodiments, each receiver is configured to receive audio signals from the surrounding, e.g., audio signals 200*a*, 200*b*, 200*c*, . . . , 200*d* received by the device 210, audio signals 202*a*, 202*b*, 202*c*, . . . , 202*d* received by the device 212, audio signals 204*a*, 204*b*, 204*c*, . . . , 204*d* received by the device 214. The one or more processors associated with each of the plurality of devices are in communication with the memory and the receiver of each respective device. The receiver can include a microphone or any suitable device to detect audio signals. In some embodiments, the receiver receives one or more audio signals.

In some embodiments, each of the plurality of devices includes an authentication and authorization engine, e.g., 210*d*, 212*d*, 214*d*. In some embodiments, each authentication and authorization engine determines whether the respective device is an authorized device, before sending the notification. In some embodiments, the authentication and authorization process is performed by the one or more processors associated with each of the plurality of devices.

In some embodiments, the memory of each of the plurality of devices is configured to store one or more criteria to detect certain types of audio signals from the one or more audio signals received by the receiver. In some embodiments, the memory stores instructions on how to use the one or more criteria. In some embodiments, the memory is configured to store further instructions to respond to detecting certain types of audio signals received from the surrounding. In some embodiments, the one or more processors of each of the plurality of devices are configured to process the received audio signals based on the stored criteria in the memory.

According to some embodiments, the one or more criteria include a frequency of the audio signals. In some embodiments, the one or more criteria include an amplitude of the audio signals. In some embodiments, the one or more criteria include a speed of sound of the audio signals. In some embodiments, the one or more criteria include a sound pattern of the audio signals. In some embodiments, the one or more criteria include a direction of the audio signals. In some embodiments, one or more audio sound patterns are stored in the memory associated with each of the plurality of devices. In some embodiments, the one or more processors determine whether each of the one or more audio signals includes an audio sound pattern that satisfies the one or more criteria stored in the memory.

In some embodiments, once the one or more processors associated with each of the plurality of devices determine that one or more received audio signals include at least one audio sound pattern that satisfies the one or more criteria stored in the memory, the device notifies the controller 230. In some embodiments, each of the plurality of devices sends a notification, e.g., a first notification 220*a*, a second notification 220*b*, . . . , an m'th notification 220*c*, to the controller 230. In some embodiments, each of the plurality of devices sends one notification for each detected audio sound pattern detected by the device. Therefore, in some embodiments, any of the plurality of devices sends any number of notifications to the controller 230. In some embodiments, the audio sound pattern is a sound pattern indicative of an emergency event.

In some embodiments, once the authentication and authorization engine determines that the device is an authorized device, the notification is sent to the controller 230. In some embodiments, once the authentication and authorization engine determines that the device is not an authorized device, the notification is not sent to the controller 230.

Figure 3:
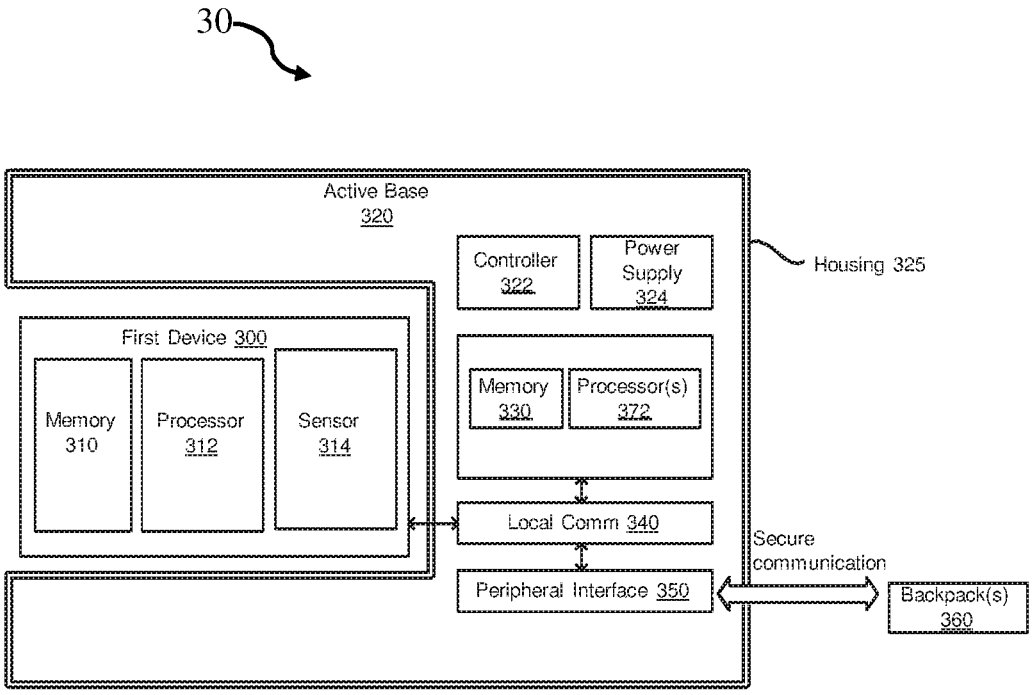
FIG. 3 is an illustration of an audio events tracking device in accordance with some embodiments.

FIG. 3 illustrates a first device 30 according to some embodiments. In some embodiments, a first device 300 is held by an active base 320. In some embodiments, the first device 300 includes a memory 310, one or more processors 312, and at least one sensor 314. In some embodiments, the sensor 314 is configured to receive audio signals from the surroundings. In some embodiments, the one or more processors 312 are in communication with the memory 310 and the sensor 314. The sensor 314 can include a microphone or any suitable device to detect audio signals. In some embodiments, the sensor 314 receives a set of audio signals. In some embodiments, the set of audio signals is received from one or more sources.

In some embodiments, the memory 310 is configured to store one or more criteria to detect certain types of audio signals from the one or more audio signals received by the receiver. In some embodiments, the memory stores instructions on how to use the one or more criteria. In some embodiments, the memory is configured to store further instructions to respond to detecting certain types of audio signals received from the surrounding. In some embodiments, the first device 300 includes the one or more processors which are configured to process the received audio signals based on the stored criteria in the memory.

According to some embodiments, the one or more criteria include a frequency of the audio signals. In some embodiments, the one or more criteria include an amplitude of the audio signals. In some embodiments, the one or more criteria include a speed of sound of the audio signals. In some embodiments, the one or more criteria include a sound pattern of the audio signals. In some embodiments, the one or more criteria include a direction of the audio signals. In some embodiments, one or more audio sound patterns are stored in the memory associated with the first device. In some embodiments, the one or more processors determine whether each of the one or more audio signals includes an audio sound pattern that satisfies the one or more criteria stored in the memory.

In some embodiments, once the one or more processors 312 determine that one or more received audio signals include at least one audio sound pattern that satisfies the one or more criteria stored in the memory, the first device 300 notifies a controller 322. In some embodiments, the first device 300 sends a notification to the controller 322. In some embodiments, the first device 300 sends one notification for each detected audio sound pattern detected by the first device 300. Therefore, in some embodiments, the first device 300 sends any number of notifications to the controller 322. In some embodiments, the audio sound pattern is a sound pattern indicative of an emergency event. In some embodiments, the one or more processors 372 perform above-mentioned tasks.

In some embodiments, the first device 300 is a smartphone. In some embodiments, the first device 300 is a smart watch. In some embodiments, the first device 300 is a pager. In some embodiments, the first device 300 includes a microphone to detect the audio signals. In some embodiments, the first device 300 uses any suitable method to detect vibrations caused by the audio signals.

In some embodiments, the active base 320 is configured to protect the second device 130 mechanically and against tracking or spying. In some embodiments, the active base 320 includes a controller 322, a power supply 324, a memory 330, one or more processors 372, and a local communication device 340 to communicate with the first device 300. The active base 320 can have one or more moveable components, e.g., a hood, operable to slide to one or more positions, e.g., up or down, as well as non-moveable components. In such embodiments, the one or more moveable components, when in a first position, e.g., hood pushed down, are mateable, e.g., mechanically and/or electrically, with the non-moving components to form a housing assembly 325, e.g., a housing. The housing 325 forms an enclosure that at least partially support and hold a first device 300, e.g., a partial enclosure or a whole enclosure encapsulating the first device 300. When in certain position(s), the housing 325, along with other components of the active base 320, protects the personal communication device 300 against tracking or spying, e.g., by audio jamming, camera covering, and/or RF shielding, etc. When the one or more moveable components of the housing 325 are in certain other position(s), e.g., hood slid up, a user can take the first device 300 out of the housing 325 and place the first device 300 in a non-protected mode.

In some embodiments, the active base 320 includes a controller 322 coupled to a peripheral interface 350 and a local communication device 340. Embodiments of the controller 322 include hardware, software, firmware, or a combination thereof. In some embodiments, the controller 322 is operable to manage the communication channel between the first device 300 and a supplemental functional device 360 and through the local communication device 340 and the peripheral interface 350. In other words, the controller 322 manages a segment of the communication channel between the first device 300 and the active base 320 through the management of the local communication device 340, and the controller 322 manages a segment of the communication channel between the active base 320 and the supplemental functional device 360 through the management of the peripheral interface 350.

In addition to managing the communication channel, the controller 322 logs data in a secure area of the active base 320. Logging data in the secure area of the active base 320 has the advantage of providing trustworthy status reports of the first device 300 for analysis in case the first device 300 has been or potentially has been compromised. For example, many high-value enterprises invest significantly to implement tight monitoring and access control within their own networks but lose visibility and control to external networks such as the cellular networks or WiFi hotspots. Once a smartphone is compromised, the status report from the phone operating system may not be trustworthy. By logging data in a secure area of the apparatus, reliable status reports can be generated for Enterprise Mobility Management (EMM), and EMM can then rely on the reliable information to limit the threat spread.

In some embodiments, the active base 320 includes a power supply 324. The power supply 324 supplies power to the peripheral interface 350, the local communication device 340, and/or the controller 322. In some embodiments, the power supply 324 includes at least one of a battery, a charging socket, a USB connector, a power plug, and/or a power socket. In some embodiments, the power supply 324 includes a connector for a battery. In some embodiments, the power supply 324 includes a plurality of power supplying components, e.g., one battery providing power to the peripheral interface 350, a power plug providing power to the local communication device 340 and/or the controller 322, etc. The plurality of power supply components can be connected to be charged together, charged separately, aggregating power to supply to one or more hardware electronic components of the active base 320, or separately providing power to one or more hardware electronic components of the active base 320.

In some embodiments, the local communication device 340 receives the information and passes to a validation engine. In some embodiments, the validation engine is stored in the memory 330 to be executed by controller 322 and validates one of more components of the first device 300 based on the information received from the local communication device 340. In some embodiments, the active base 320 includes one or more processors 372.

In some embodiments, the active base 320 includes a peripheral interface 350, e.g., a backpack interface, to connect to a supplemental functional device 360, e.g., a backpack. The supplemental functional device 360, as described herein, is a device connectable to the first device 300 through the active base 320 and provides supplemental functional functions to the first device 300. The peripheral interface 350 of the active base 320 is connectable to peripheral interface of the supplemental functional device 360, so that a secure communication channel between supplemental functional device 360 and the first device 300 can be established.

In some embodiments, the housing 325 of the active case 320 at least partially supports the peripheral interface 350 of the active case 320. For example, the peripheral interface 350 can include a number of connectors, e.g., contact pins or contact pads, connectable to the supplemental functional device 360. In some embodiments, the connectors are affixed to the housing 325 of the active case 320 and at least partially supported by the housing 325 of the active case 320. The connectors are mateable to the peripheral interface of the backpack 360. In some embodiments, the peripheral interface 350 of the active case 320 is wholly supported by the housing 325 of the active case 320, such that the peripheral interface 350 is integrated with or embedded in the housing surface. In such embodiments, connectors from the backpack 360 can be plugged into the peripheral interface 350 of the active case 320 in order to connect the backpack 360 to the active base 320. In some embodiments, the peripheral interface 350 of the active case 320 is operable to communicate with the supplemental functional device 360 via a physical channel including communication connectors. The physical channel forms a secure channel for communication between the active base 320 and the backpack 360.

In some embodiments, the peripheral interface 350 of the active case 320 and/or the backpack 360 is a wireless interface that includes a wireless modem operable to communication wirelessly. For example, the active base 320 can connect to a wireless communication enabled backpack device 360 through a wireless peripheral interface or through a wireless modem of the active case 320. As such, a wireless communication enabled backpack 360 can communicate with the active base 320 without being in contact with the housing 325 of the active case 320 or physically connected to the peripheral interface 350 of the active case 320. In some embodiments, the controller 322 is in the first device 310.

Figure 4A:
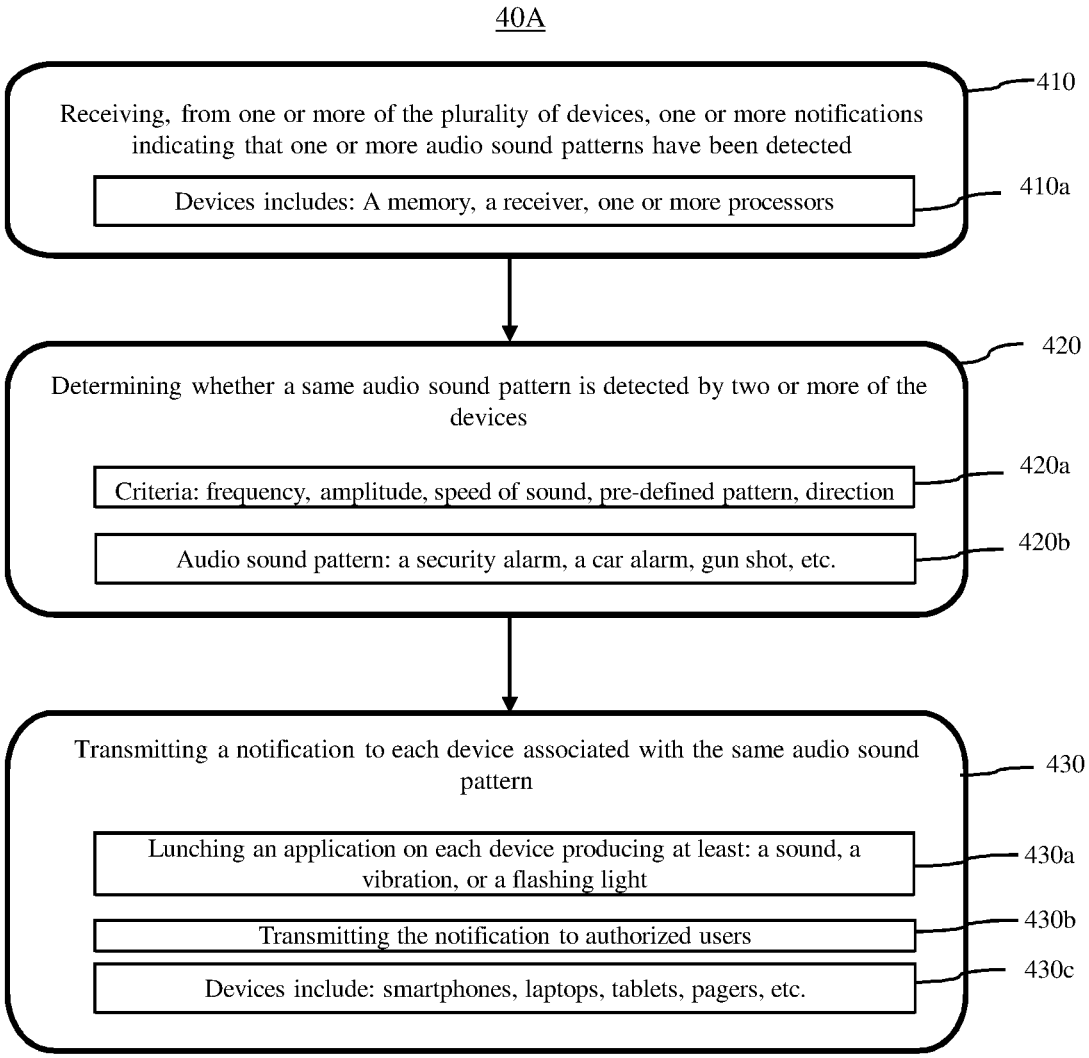
FIGS. 4A-4B are flowcharts illustrating a method of audio events tracking in accordance with some embodiments.

FIG. 4A illustrates a flowchart of a method for audio events tracking 40A according to some embodiments. As represented by block 410, the method includes receiving, from one or more of the plurality of devices, one or more notifications indicating that one or more audio sound patterns have been detected. In some embodiments, the plurality of devices is in communication with a controller through a network. The plurality of devices and the controller can communicate through a wireless network, e.g., a Wi-Fi network, an LTE network, etc. In some embodiments, at least one of the plurality of devices is a smartphone. In some embodiments, at least one of the plurality of devices is a smart watch. In some embodiments, at least one of the plurality of devices is a pager. In some embodiments, at least one of the plurality of devices includes a microphone to detect the audio signals. In some embodiments, at least one of the plurality of devices uses any suitable method to detect vibrations caused by the audio signals.

In some embodiments, at least one of the plurality of devices includes a receiver, a memory and one or more processors, as represented by block 410*a*. In some embodiments, the receiver is configured to receive audio signals from the surrounding. The one or more processors are in communication with the memory and the receiver. The receiver can include a microphone or any suitable device to detect audio signals. In some embodiments, the receiver receives one or more audio signals. In some embodiments, the one or more audio signals are received from one or more sources.

In some embodiments, the memory is configured to store one or more criteria to detect certain types of audio signals from the one or more audio signals received by the receiver. In some embodiments, the memory stores instructions on how to use the one or more criteria. In some embodiments, the memory is configured to store further instructions to respond to detecting certain types of audio signals received from the surrounding. In some embodiments, the one or more processors are configured to process the received audio signals based on the stored criteria in the memory.

In some embodiments, the method 40A includes determining whether a same audio sound pattern is detected by two or more of the devices, as represented by block 420. In some embodiments, once the one or more processors associated with a device of the plurality of devices determine that one or more received audio signals include at least one audio sound pattern that satisfies the one or more criteria stored in the memory, the device notifies the controller.

According to some embodiments, the one or more criteria include at least one of a frequency of the audio signals, an amplitude of the audio signals, a speed of sound of the audio signals, and a sound pattern of the audio signals, a direction of the audio signals, as represented by block 420*a*. In some embodiments, one or more audio sound patterns are stored in the memory associated with each of the plurality of devices.

In some embodiments, the audio sound pattern is a sound pattern indicative of an emergency event, e.g., a security alarm, a car alarm, a gunshot, etc. as represented by block 420*b*. For example, the controller determines that more than one device has detected an alarm.

In some embodiments, the method 40A further includes transmitting a notification to each device associated with the same audio sound pattern. In some embodiments, in association with transmitting the notification, an application is launched on each device. In some embodiments and, the application produces at least one of a sound, a vibration, and a flashing light, as represented by block 430*a*, In some embodiments, the controller sends notification only to authorized devices, as represented by block 430*b*. In some embodiments, the device is a pager. As represented by block 430*c*, in some embodiments, the device is at least one of a smart phone, a smart watch, a laptop, a pager, and a tablets.

Figure 4B:
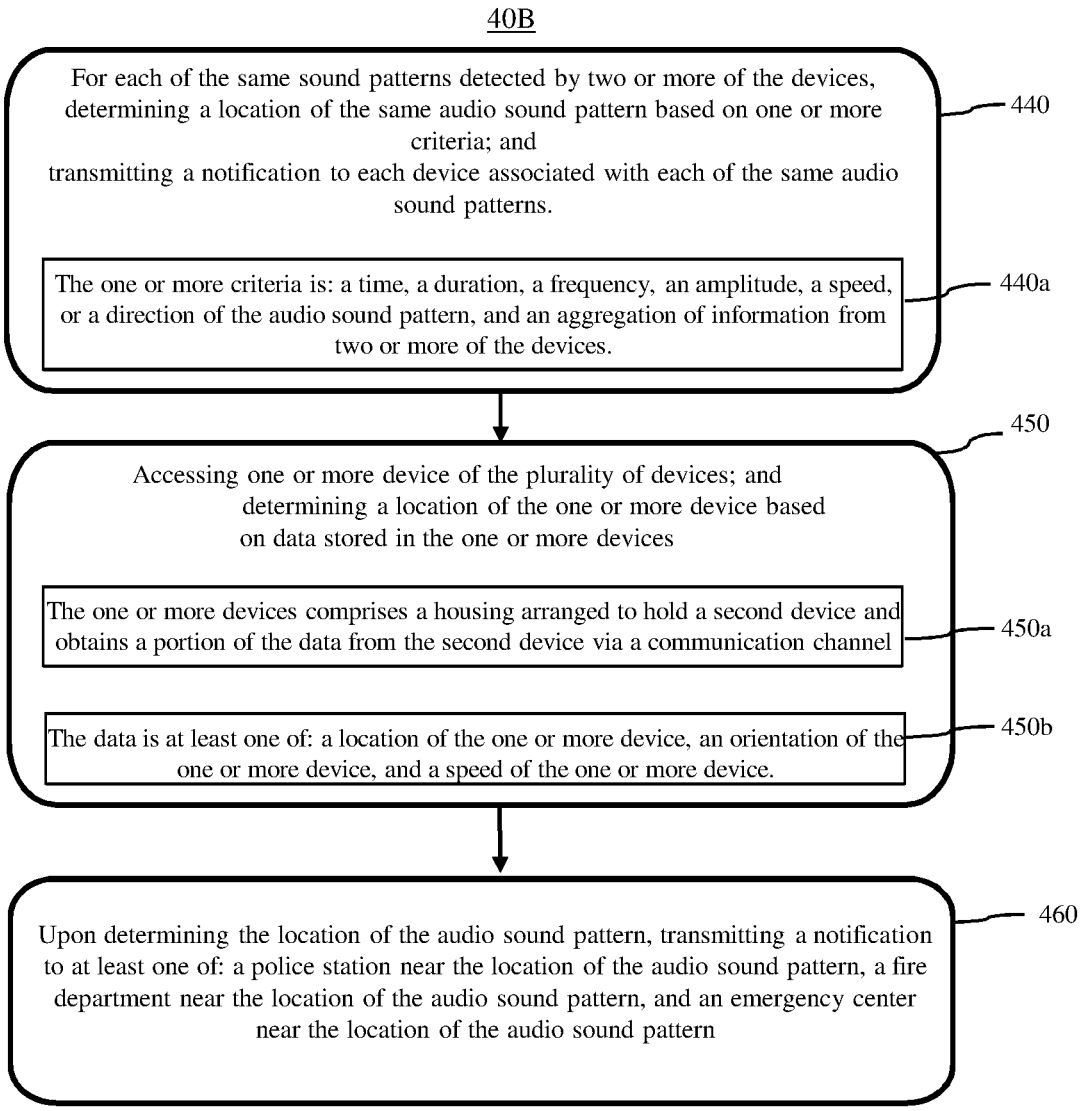

FIG. 4B illustrates a flowchart of a method for audio events tracking 40B according to some embodiments. In some embodiments, the method 40B includes, for each of the same sound patterns detected by two or more of the devices, determining a location of the same audio sound pattern based on one or more criteria. The method 40B further includes transmitting a notification to each device associated with each of the same audio sound patterns, as represented by block 440. As represented by block 440*a*, in some embodiments, the one or more criteria used by the controller is a time the audio sound pattern is detected. In some embodiments, the one or more criteria used by the controller is a duration of the audio sound pattern. In some embodiments, the one or more criteria used by the controller is a frequency of the audio sound pattern. In some embodiments, the one or more criteria used by the controller is an amplitude of the audio sound pattern. In some embodiments, the one or more criteria used by the controller is a speed of the audio sound pattern. In some embodiments, the one or more criteria used by the controller is a direction of the audio sound pattern. In some embodiments, the one or more criteria used by the controller is and an aggregation of information from two or more of the devices.

In some embodiments, the method 40B includes accessing one or more device of the plurality of devices. In some embodiments, the method 40B further includes determining a location of the one or more device based on data stored in the one or more devices, as represented by block 450. In some embodiments, the one or more devices comprises a housing arranged to hold a second device and obtains a portion of the data from the second device via a communication channel, as represented by block 450*a*. In some embodiments, each of the one or more devices includes an authentication and authorization engine. In some embodiments, each authentication and authorization engine determines whether the respective device is an authorized device, before sending the notification. In some embodiments, the authentication and authorization process is performed by the one or more processors associated with each of the one or more devices. In some embodiments, determining a location of the one or more device is performed based on data stored in the one or more devices. In some embodiments, a device of the one or more devices includes a housing arranged to hold a second device and obtains a portion of the data from the second device via a communication channel between the second device and the device.

As represented by block 450*b*, in some embodiments, the data is at least one of a location of the one or more device, an orientation of the one or more device, and a speed of the one or more device.

As represented by block 460, in some embodiments the method 40B includes, upon determining the location of the audio sound pattern, transmitting a notification to at least one of: a police station near the location of the audio sound pattern, a fire department near the location of the audio sound pattern, and an emergency center near the location of the audio sound pattern.

Figure 5:
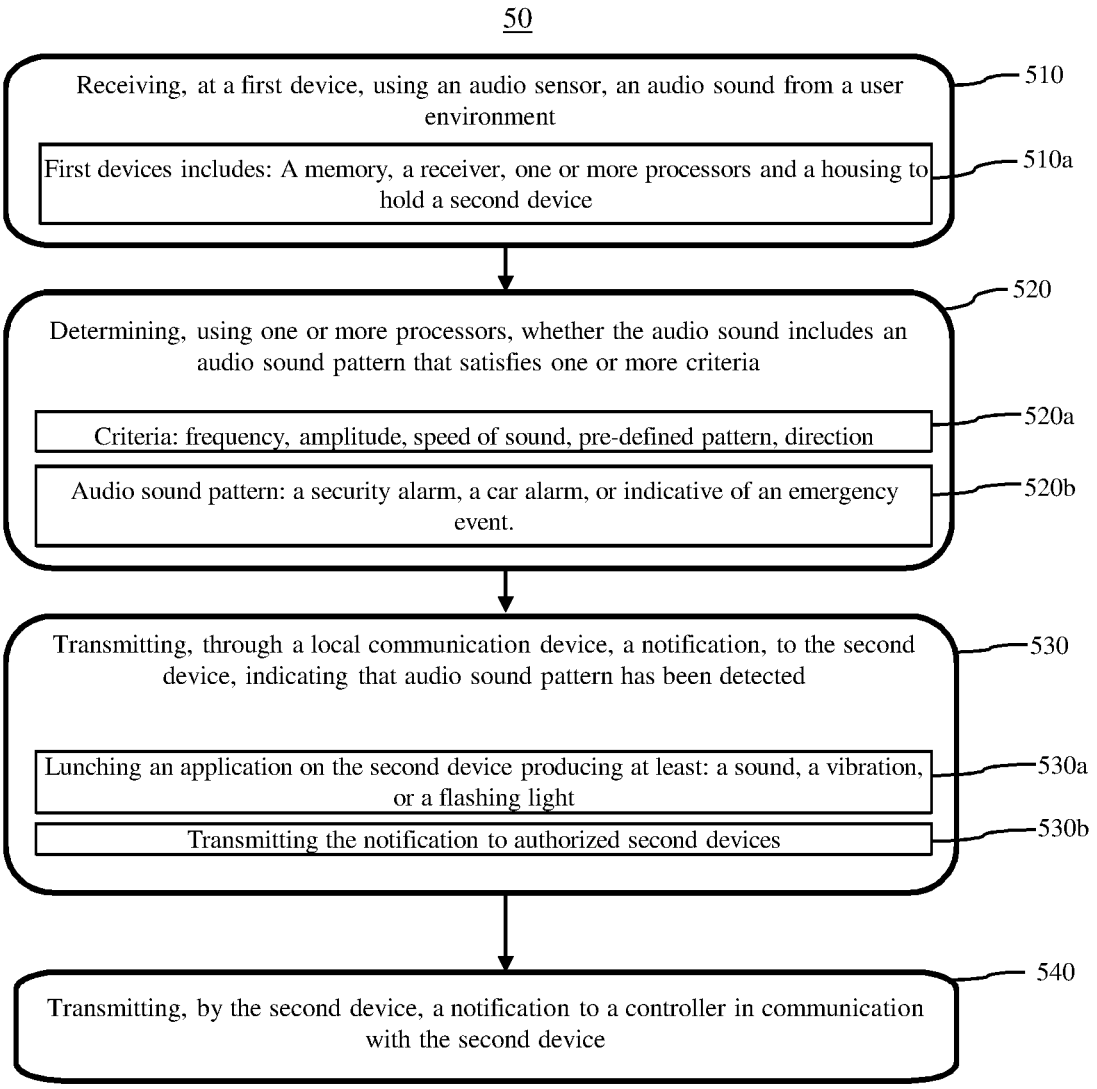
FIG. 5 is a flowchart illustrating a method of audio events tracking in accordance with some embodiments.

FIG. 5 illustrates a flowchart of a method 50 for audio events tracking according to some embodiments. As represented by block 510, the method 50 includes receiving, at a first device, using an audio sensor, an audio sound from a user environment. In some embodiments, the device is a smartphone. In some embodiments, the device is a smart watch. In some embodiments, the device is a pager. In some embodiments, the device includes a microphone to detect the audio signals. In some embodiments, the device uses any suitable method to detect vibrations caused by the audio signals.

In some embodiments, the device includes a receiver, a memory, one or more processors, and a housing to hold a second device, as represented by block 510*a*. In some embodiments, the receiver is configured to receive audio signals from the surrounding. The one or more processors are in communication with the memory and the receiver. The receiver can include a microphone or any suitable device to detect audio signals. In some embodiments, the receiver receives one or more audio signals. In some embodiments, the one or more audio signals are received from one or more sources.

In some embodiments, the memory is configured to store one or more criteria to detect certain types of audio signals from the one or more audio signals received by the receiver. In some embodiments, the memory stores instructions on how to use the one or more criteria. In some embodiments, the memory is configured to store further instructions to respond to detecting certain types of audio signals received from the surrounding. In some embodiments, the one or more processors are configured to process the received audio signals based on the stored criteria in the memory.

As represented by block 520, the method 50 includes determining, using one or more processors, whether the audio sound includes an audio sound pattern that satisfies one or more criteria. According to some embodiments, the one or more criteria include at least one of a frequency of the audio signals, an amplitude of the audio signals, a speed of sound of the audio signals, and a sound pattern of the audio signals, a direction of the audio signals, as represented by block 520*a*. In some embodiments, one or more audio sound patterns are stored in the memory associated with each of the plurality of devices.

In some embodiments, the audio sound pattern is a sound pattern indicative of an emergency event, e.g., a security alarm, a car alarm, a gunshot, etc. as represented by block 520*b*. For example, the controller determines that more than one device has detected an alarm.

In some embodiments, the method 50 further includes transmitting through a local communication device, a notification, to the second device, indicating that audio sound pattern has been detected, as represented by block 530. In some embodiments, in association with transmitting the notification, an application is launched on the second device. In some embodiments, the application produces at least one of a sound, a vibration, and a flashing light, as represented by block 530*a*. In some embodiments, the first device sends notification only to authorized second devices, as represented by block 530*b*. In some embodiments, the device is at least one of a smart phone, a smart watch, a laptop, a pager, and a tablet.

In some embodiments, the method 50 further includes transmitting, by the second device, a notification to a controller in communication with the second device, as represented by block 540.

Figure 6:
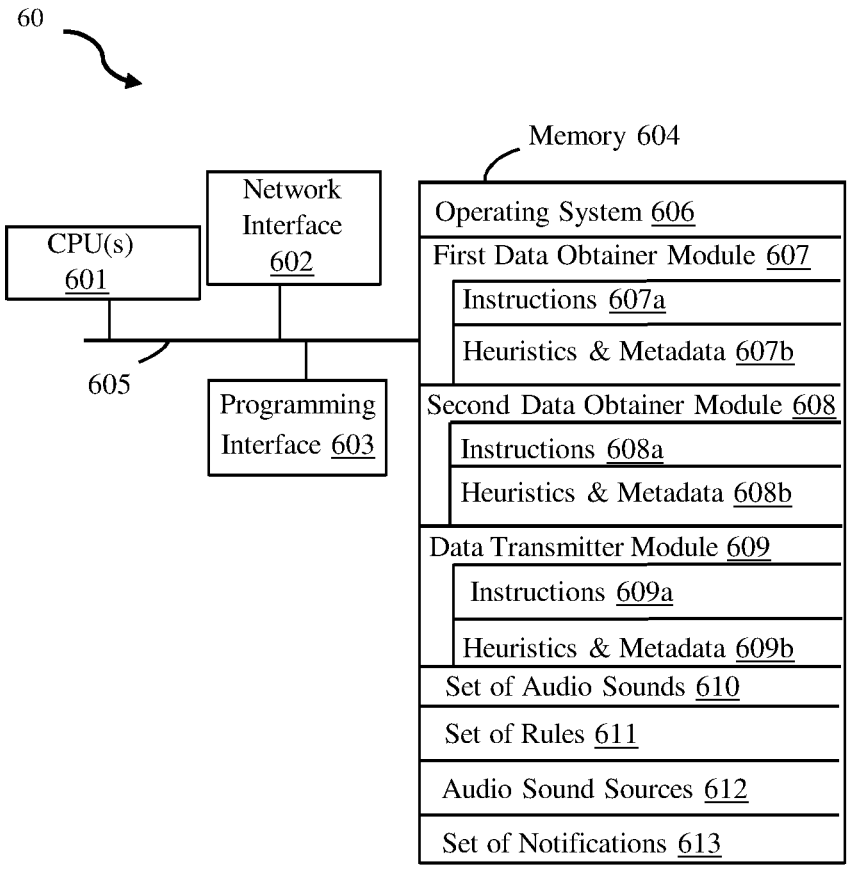
FIG. 6 is an illustration of an audio events tracking system in accordance with some embodiments.

FIG. 6 is a block diagram of a server system 60 enabled with some modules associated with and/or included in a system for detecting audio sound patterns and notifying authorized users in accordance with some embodiments. In other words, in some embodiments, the server system 60 implements detecting audio sound patterns and notifying authorized users. While certain specific features are illustrated, those of ordinary skill in the art will appreciate from the present disclosure that some other features have not been illustrated for the sake of brevity, and so as not to obscure more pertinent aspects of the embodiments disclosed herein. To that end, as a non-limiting example, in some embodiments the server system 60 includes one or more processing units (CPUs) 601, a network interface 602, a programming interface 603, a memory 604, and one or more communication buses 605 for interconnecting these and some other components.

In some embodiments, the network interface 602 is provided to, among other uses, establish and maintain a metadata tunnel between a cloud-hosted network management system and at least one private network including one or more compliant devices. In some embodiments, the one or more communication buses 605 include circuitry that interconnects and controls communications between system components. The memory 604 includes high-speed random-access memory, e.g., DRAM, SRAM, DDR RAM or other random-access solid-state memory devices, and may include non-volatile memory, e.g., one or more magnetic disk storage devices, optical disk storage devices, flash memory devices, or other non-volatile solid-state storage devices. The memory 604 optionally includes one or more storage devices remotely located from the one or more CPUs 601. The memory 604 comprises a non-transitory computer readable storage medium.

In some embodiments, the memory 604 or the non-transitory computer readable storage medium of the memory 604 stores the following programs, modules and data structures, or a subset thereof including an optional operating system 606, a first data obtainer module 607, a second data obtainer module 608, a data transmitter module 609, a set of audio signals 610, a set of rules 611, audio signals sources 612, and a set of notifications 613.

The operating system 606 includes procedures for handling some basic system services and for performing hardware dependent tasks. In some embodiments, the first data obtainer module 607 and the second data obtainer module 608 obtain data from the client devices or the audio sound monitors. To that end, in some embodiments, the first data obtainer module 607 and the second data obtainer module 608 include instructions and/or logic 607*a* and 608*a*, and heuristics and metadata 607*b* and 608*b*.

In some embodiments, the data transmitter module 609 transmits data to the client devices or the validation engines. To that end, the data transmitter module 609 includes instructions and/or logic 609*a*, and heuristics and metadata 609*b*. In some embodiments, the data obtainer modules 607 and 608 obtain the set of audio signals 610 from the audio signals sources 612. In some embodiments, the data transmitter module 609 transmits the set of notifications 613 to the data obtainer modules 607 and 608 based on the set of rules 611.

The foregoing description, for purpose of explanation, has been described with reference to specific embodiments. However, the illustrative discussions above are not intended to be exhaustive or to limit the invention to the precise forms disclosed. Many modifications and variations are possible in view of the above teachings. The embodiments were chosen and described in order to best explain the principles of the invention and its practical applications, to thereby enable others skilled in the art to best use the invention and various described embodiments with various modifications as are suited to the particular use contemplated.

What is claimed is:

1. A method comprising:

at a server including one or more processors and non-transitory memory, the server in communication with a plurality of active bases, wherein each of the plurality of active bases includes a controller, a housing arranged to hold a respective device, and one or more communication devices connectable to the respective device and the server;

receiving, from one or more of the plurality of active bases, data indicating that one or more audio sound patterns have been detected, wherein each of the one or more active bases transmits the data upon validating the respective device and determining whether a respective audio sound pattern in audio sound from a user environment satisfying one or more criteria has been detected, and each of the one or more active bases obtains audio data representing the audio sound from the respective device via a local communication device of the one or more communication devices;

aggregating the data from two or more of the plurality of active bases;

determining whether a same audio sound pattern is detected by the two or more of the plurality of active bases based on the aggregated data; and transmitting a notification to each of the two or more of the plurality of active bases associated with the same audio sound pattern indicating a location of the same audio sound pattern upon determining that the same audio sound pattern has been detected by the two or more of the plurality of active bases.

2. The method of claim 1, further comprising:

determining a respective location of the respective device based on respective data stored on each of the plurality of the active bases.

3. The method of claim 1, wherein the one or more criteria include one or more of a time of the respective audio sound pattern, a duration of the respective audio sound pattern, a frequency of the respective audio sound pattern, an amplitude of the respective audio sound pattern, a speed of the respective audio sound pattern, and a direction of the audio sound pattern.

4. The method of claim 1, wherein each of the one or more active bases obtains the audio data representing the audio sound from the respective device via the local communication device by, for an active base of the one or more active bases, wherein the active base includes a respective housing arranged to hold a device:

establishing a communication channel with the device via the local communication device; and obtaining at least a portion of the audio data from the device via the communication channel.

5. The method of claim 1, wherein the data includes one or more of a location of the one or more devices, an orientation of the one or more devices, and a speed of the one or more devices.

6. The method of claim 1, further comprising:

causing each active base in the two or more of the plurality of active bases to instruct the respective device to launch an application on the respective device, wherein the application produces one or more of a sound, a vibration, and a flashing light.

7. The method of claim 1, wherein the respective device includes a smartphone.

8. The method of claim 1, wherein the respective audio sound pattern is a sound pattern indicative of an emergency event.

9. The method of claim 1, further comprising:

upon determining the location of the same audio sound pattern, notifying one or more of: a police station near the location of the same audio sound pattern, a fire department near the location of the same audio sound pattern, and an emergency center near the location of the same audio sound pattern.

10. A method comprising:

at an active base including a housing, a controller, non-transitory memory, and one or more communication devices, wherein the housing is arranged to hold a device, and the one or more communication devices are connectable to the device and a server:

receiving from the device, via a local communication device of the one or more communication devices, audio data representing audio sound from a user environment;

validating the device and determining, by the controller, whether the audio sound includes an audio sound pattern that satisfies one or more criteria;

transmitting, upon validating the device, data to the server indicating that the audio sound pattern satisfying the one or more criteria has been detected;

causing the server to aggregate data from multiple active bases that indicate audio sound patterns satisfying the one or more criteria have been detected, determine a location of the audio sound pattern and generate a notification based on the aggregated data; and transmitting, via the local communication device to the device, the notification upon receiving the notification from the server.

11. The method of claim 10, wherein the device is a smartphone.

12. The method of claim 10, wherein the one or more criteria comprises one or more of a time of the audio sound pattern, a duration of the audio sound pattern, a frequency of the audio sound pattern, an amplitude of the audio sound pattern, a speed of sound of the audio sound pattern, and a direction of the audio sound pattern.

13. The method of claim 10, wherein the audio sound pattern is a sound pattern indicative of an emergency event.

14. The method of claim 10, wherein the device comprises an audio sensor for detecting the audio sound from the user environment and generating the audio data representing the audio sound.

15. An apparatus comprising:

a housing arranged to a hold a device;

one or more communication devices, connectable to the device and a server, including a local communication device;

non-transitory memory; and a controller, the controller configured to:

receive, from the device, via the local communication device, audio data representing audio sound from a user environment;

validate the device and determine whether the audio sound includes an audio sound pattern that satisfies one or more criteria;

direct the one or more communication devices to transmit, upon validating the device, data to the server indicating that the audio sound pattern satisfying the criteria has been detected;

cause the server to aggregate data from multiple active bases that indicate audio sound patterns satisfying the criteria have been detected;

cause the server to determine a location of the audio sound pattern and generate a notification based on the aggregated data; and direct the local communication device to transmit the notification to the device upon receiving the notification from the server.

16. The apparatus of claim 15, wherein in response to receiving the notification, instruct, via the local communication device, the device to launch an application, wherein the application produces one or more of a sound, or a vibration, or a flashing light.

17. The apparatus of claim 15, wherein the device is a smartphone.

18. The apparatus of claim 15, wherein the audio sound pattern is a sound pattern indicative of an emergency event.

19. The apparatus of claim 15, wherein the one or more criteria includes at least one of a time of the audio sound pattern, a duration of the audio sound pattern, a frequency of the audio sound pattern, an amplitude of the audio sound pattern, a speed of the audio sound pattern, or a direction of the audio sound pattern.

20. The apparatus of claim 15, wherein the controller is further configured to, instruct the one or more communication devices to notify one or more of a police station near the location of the audio sound pattern, a fire department near the location of the audio sound pattern, and an emergency center near the location of the audio sound pattern.

* * * * *